US005957674A

United States Patent [19]

Zenmei et al.

[11] Patent Number: 5,957,674

[45] Date of Patent: Sep. 28, 1999

[54] VARIABLE-DISCHARGE HIGH PRESSURE PUMP

[75] Inventors: Keisaku Zenmei; Nobuyuki Kanda; Keiichi Konishi, all of Tokyo, Japan

[73] Assignee: Mitsubishi Denki Kabushiki Kaisha, Tokyo, Japan

[21] Appl. No.: 08/795,243

[22] Filed: Feb. 10, 1997

[30] Foreign Application Priority Data

Jul. 1, 1996 [JP] Japan ..... 8-171336

[51] Int. Cl.[6] ..... F02M 37/04

[52] U.S. Cl. ..... 417/505; 92/171.1; 123/446; 123/495

[58] Field of Search ..... 417/440, 505, 417/570; 92/128, 171.1; 123/456, 506, 446, 495

[56] References Cited

U.S. PATENT DOCUMENTS

| | | | |
|---|---|---|---|
| 4,526,150 | 7/1985 | Güntert et al. . | |
| 4,597,371 | 7/1986 | Wissmann et al. | 123/495 |
| 5,094,216 | 3/1992 | Miyaki et al. . | |
| 5,307,778 | 5/1994 | Hummel et al. | 123/495 |
| 5,771,864 | 6/1998 | Morishita et al. | 123/456 |

FOREIGN PATENT DOCUMENTS

A-436073 2/1992 Japan .

*Primary Examiner*—Timothy S. Thorpe
*Assistant Examiner*—Apollo Nguyen
*Attorney, Agent, or Firm*—Sughrue, Mion, Zinn, Macpeak & Seas, PLLC

[57] ABSTRACT

A variable-discharge high pressure pump capable of facilitating the manufacturing and providing sufficient lubrication. The pump comprises a cam shaft provided with a cam surface by which a tappet displaces in accordance with the cam surface, a plunger connected to the tappet to reciprocate in accordance with the reciprocation of the tappet and accommodated in a cylindrical cylinder. Also included are a cylinder head having a contact surface brought into contact with one end surface of the cylinder. The cylinder head has a small-diameter recess portion made in the contact surface to be coupled to the cylinder and constitutes a pump chamber in conjunction with a head portion of the plunger. Further, the cylinder head holds a fuel introduction device for introducing external fuel into a fuel supply passage communicating with the pump chamber, a solenoid valve for opening and closing the fuel supply passage in accordance with an energization state thereto, and a fuel discharging device for discharging fuel compressed in the pump chamber. The cylinder is placed through a fixing device into contact with the cylinder head.

3 Claims, 5 Drawing Sheets

——— : BEFORE DEFORMATION

- - - - : AFTER DEFORMATION

VARIABLE-DISCHARGE HIGH PRESSURE PUMP

BACKGROUND OF THE INVENTION

1. Field of the Invention

The present invention relates to a variable-discharge high pressure pump which varies the discharging quantity of fuel on the basis of the timing of energization to (actuation of) a solenoid valve.

2. Description of the Prior Art

FIG. 5 is a cross-sectional view showing a prior variable-discharge high pressure pump disclosed by, for example, Japanese Unexamined Patent Publication No. 4-36073. The prior variable-discharge high pressure pump 106 is equipped with a cam shaft 111 which rotates with a crank shaft of an engine. Around the cam shaft 111 there is defined a cam surface 112 which rises and falls in accordance with the rotation of the cam shaft 111. The cam surface 112 includes two heights and is of the so-called two-high type. The cam shaft 111 is located within a cam chamber 114 existing at a lower portion (a lower side in FIG. 5 when being mounted on a motor vehicle) of a housing 113. The housing 113 accommodates a substantially cylindrical room 115 where a tappet 116 is supported to be allowed to reciprocate in the directions of the axis of the cylindrical configuration. The tappet 116 is, at its cam surface 112 side, provided with a cam roller 118, and the cam roller 118 rolls in response to the rotation of the cam shaft 111 as it turns being while in contact with the cam surface 112, causing the tappet 116 to shift up and down in accordance with the variation of the cam surface 112.

Furthermore, in an upper portion (an upper side in FIG. 5 when being mounted on a motor vehicle) of the housing 113, a cylinder 120 is fixedly provided in a state that its central portion invades the interior of the room 115. In the central portion of the cylinder 120, there is made a plunger sliding section 120*a* awhich is a bar-like hole having a circular cross section, and a plunger 127 is inserted thereinto to be allowed to reciprocate in its axial directions. This plunger 127 has a bar-like configuration with a circular cross section and its lower end portion is in connecting relation to the tappet 116, so that in response to the reciprocating action of the tappet 116, the plunger 127 reciprocates in the interior of the plunger sliding section 120*a*. A pump chamber 121 is defined in a portion surrounded by the top surface of the plunger 127 and an inner circumferential surface of the plunger sliding section 120*a* of the cylinder 120. The top surface of the plunger 127 compresses the fuel within the pump chamber 121.

In the cylinder 120, a fuel introduction means 128 is placed for the purpose of introducing fuel into the variable-discharge high pressure pump 106. In addition, accommodated therein is a solenoid valve 130 being under the energization control of a control unit (not shown). The solenoid valve 130 is installed in such a manner that a male screw portion 130*a* made in its own outer circumference is engaged with a female screw portion 120*b* made in a fitting section of the cylinder 120 and tightened to be fixed in a state that its bottom portion comes into contact with a step portion of the fitting section. This solenoid valve 130 is for opening and closing a fuel supply passage 131 for leading fuel to the pump chamber 121. For example, when the solenoid valve 130 is in the energized or driven condition, the fuel supply passage 131 is in the closed state, whereas the fuel supply passage 131 comes into the open state in response to stopping the energization thereto. Further, in the cylinder 120, a fuel discharging means 132 is installed to discharge the fuel compressed in the pump chamber 121 toward the exterior of the variable-discharge high pressure pump 106. The fuel discharging means 132 has a check valve 133 therein.

Secondly, a description will be made hereinbelow of an operation of the variable-discharge high pressure pump 106. The fuel is supplied through the fuel introduction means 128 and the fuel supply passage 131 into the pump chamber 121. Further, when the solenoid valve 130 is actuated by the control while the plunger 127 rises, the solenoid valve 130 closes the fuel supply passage 131. Thus, the fuel within the pump chamber 121, compressed in accordance with the rise of the plunger 127, stops to escape through the fuel supply passage 131 and reaches a high pressurized state. When the pressure within the pump chamber 121 rises to open the check valve 133, the pressurized fuel is discharged through the fuel discharging means 132 to the external.

In general, in the case of the four-cylinder engine, the variable discharge high pressure pump needs to discharge the fuel four times during one revolution of the engine crank shaft. For this reason, in the case of the use of such a variable-discharge high pressure pump 106 with the two-high cam, one engine requires two variable-discharge high pressure pumps 106. Recently, in order to increase the discharge quantity of the variable-discharge high pressure pump to decrease the number of the pumps, the trend is toward further increasing the number of cam heights on the cam surface 112 to increase the number of sliding movements of the plunger 127 per one revolution of the cam shaft 111.

In the case of the prior variable-discharge high pressure pump 106 thus constructed, the inner circumferential surface of the plunger sliding section 120*a* of the cylinder 120 is required to have an extremely high processing accuracy because of the sliding action of the plunger 127 and the compression of fuel. In addition, the inner circumferential surface of the plunger sliding section 120*a* is required to be free from the deformation hindering the sliding movements of the plunger 127 after the completion of the final assembling. More specifically, it is necessary that the bending deformation of the plunger sliding section 120*a* in the axial directions or the inward projection of the inner surface of the plunger sliding section 120*a* does not take place. Thus, the cylinder 120 is wholly constructed to have a high rigidity in order to prevent the deformations of the fitting portions due to the attachments of the solenoid valve 130 and the fuel discharging means 132 from having influence on the plunger sliding section 120*a*.

FIG. 6 shows a structural analysis result of the cylinder 120 after the completion of assembling of the prior variable-discharge high pressure pump 106, where only one side of the cross section of the cylinder 120 is illustrated but the other side is omitted for brevity. This illustration signifies a state of the deformation of the cylinder 120 caused by the force occurring due to the fixing of the solenoid valve 130 onto an upper portion of the cylinder 120. The solenoid valve 130 is mounted in such a manner that the male screw portion 130*a* made in its own outer circumference is engaged with the female screw portion 120*b* made in the fitting section, and fixed so that its bottom surface is brought into contact with a step portion of the fitting section. For this reason, there develop the force Q applied to enlarge the fitting section and the force P exerted to press the fitting section upwardly due to the reaction against the contact of the bottom surface therewith. In this instance, the force P is approximately 3600 kgf while the force Q is approximately 1300 kgf. These forces P and Q make the plunger sliding section 120*a* of the cylinder 120 deform as indicated by a dotted line in the illustration. As described before, the cylinder 120 is made to exhibit a high rigidity so that the deformation due to the installation of the solenoid valve 130 and the fuel discharging means 132 does not have influence on the plunger sliding section 120*a*. Accordingly, the deformation of the plunger sliding section 120*a* is small as 0.6 m as illustrated in a state with the fixed solenoid valve 130.

However, in the case of the prior variable-discharge high pressure pump thus constructed, in the cylinder 120 there are formed the installation section for installing the solenoid valve 130 and the fuel discharging means 132 and the fuel supply passage 131 for leading the fuel, which makes its configuration complicated. In addition, the cylinder 120 is designed to have a high rigidity to prevent the force due to the fitting of the solenoid valve 130 and the fuel discharging means 132 from having influence upon the other sections. Further, the plunger sliding section 120*a* of the cylinder 120 requires a high accuracy because of permitting the reciprocating movement and the compression of fuel. For these reasons, difficulty is experienced to easily manufacture the cylinder 120 with a high accuracy.

On the other hand, in proportion to the recent tendency to increase the number of heights of the cam, the sliding speed of the plunger 127 becomes higher an is, therefore, more prone to the seizure. Accordingly, the processing accuracy of the plunger sliding section 120*a* needs further improving, besides the plunger sliding section 120*a* requires a high lubrication performance.

SUMMARY OF THE INVENTION

The present invention has been developed in order to eliminate the above-mentioned problems, and it is therefore an object of this invention to provide a variable-discharge high pressure pump which is easy to manufacture and which is exhibits a high performance in sliding surface lubrication.

In accordance with the present invention, there is provided a variable-discharge high pressure pump comprising a cam shaft driven to rotate and provided with a cam surface therearound, a tappet pressed against the cam surface to be displaced in accordance with the cam surface, a housing for holding the tappet to allow it to reciprocate, a pole-like plunger having no stop groove and connected to the tappet to reciprocate therewith, a cylindrical cylinder accommodating the plunger to allow it to reciprocate, a cylinder head having a contact surface brought and placed into contact with one end surface of the cylinder and including a small-diameter recess portion made in the contact surface to be communicated with the cylinder and to constitute a pump chamber in conjunction with a head portion of the plunger, fuel introduction means placed on the cylinder head to introduce external fuel into a fuel supply passage communicating with the pump chamber, a solenoid valve fitted on the cylinder head to open and close the fuel supply passage in accordance with an energization state, fuel discharging means fitted on the cylinder head to discharge fuel compressed in the pump chamber, and fixing means for bringing and placing the cylinder into contact with the cylinder head.

With this structure, the cylinder is placed into separation from the cylinder head, and the configuration becomes simple, which makes the processing easy. Further, the cylinder head does not convey its own deformation occurring at assembling to the cylinder and, hence, does not require an extremely high rigidity. Besides, the cylinder is free from the deformation to hinder the sliding action of the plunger after the completion of the assembly, so that the system quality improves.

In the variable-discharge high pressure pump, the cylinder is composed of a thick wall cylindrical section and a thin wall cylindrical section, and a step portion defined between the thick wall cylindrical section and the thin wall cylindrical section is pressed toward the cylinder head so that its thick wall cylindrical section side end surface is brought and placed into contact with the contact surface of the cylinder head.

Thus, the inner circumferential surface of the cylinder near its step portion becomes inflated or expanded to form a ring-like configuration along its circumferential direction to define a room between the outer circumferential surface of the plunger and the inner circumferential surface of the cylinder. Accordingly, when the variable-discharge high pressure pump is driven, the fuel leaking through a gap between the plunger and the cylinder stays in this room, which provides proper lubrication for the sliding motion of the plunger, with the result that the sliding motion of the plunger becomes smooth to stabilize the system performance.

In addition, the cylinder head has a large-diameter recess portion made about the contact surface and the small-diameter recess portion, and the fixing means has a disc-like fixing means body and the thin wall cylindrical section of the cylinder is inserted into a through-hole made at a central portion of the fixing means body and further a male screw portion made in an outer circumference of the fixing means is engaged with a female screw portion made in the large-diameter recess portion, and the step portion of the cylinder is pressed toward the cylinder head, and a low pressure fuel gallery is defined by an inner surface of the large-diameter recess portion, an outer surface of the thick wall cylindrical section of the cylinder and a main surface of the fixing means body. This structure can facilitate the formation of the low pressure fuel gallery.

BRIEF DESCRIPTION OF THE DRAWINGS

The object and features of the present invention will become more readily apparent from the following detailed description of the preferred embodiments taken in conjunction with the accompanying drawings in which.

DESCRIPTION OF THE PREFERRED EMBODIMENTS

First Embodiment

Figure 1:
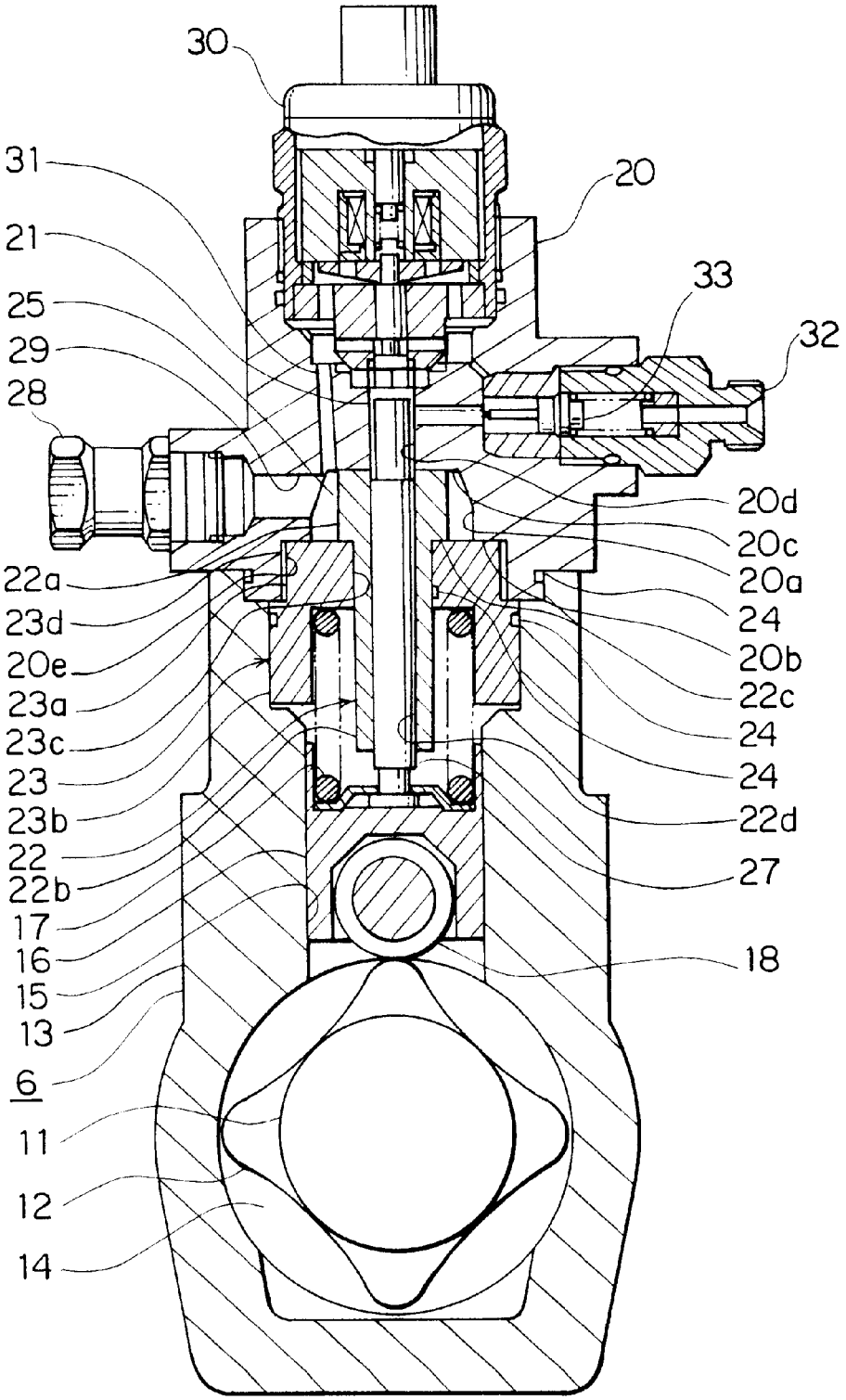
FIG. 1 is a cross-sectional view showing a variable-discharge high pressure pump according to the present invention.
Figure 2:
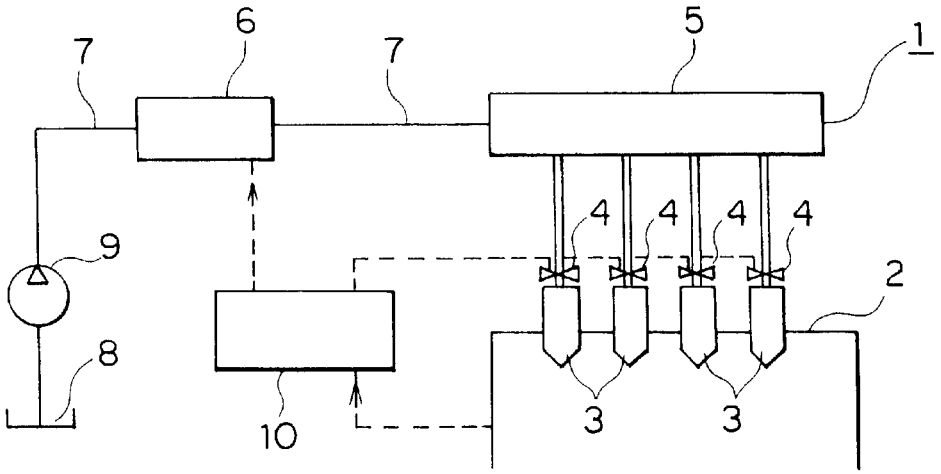
FIG. 2 is a block diagram schematically showing a common rail type fuel injection system.

The description will be made hereinbelow of a first embodiment of the present invention with reference to FIG. 1 being a cross-sectional view showing a variable-discharge high pressure pump and FIG. 2 being a block diagram schematically showing a common rail type fuel injection system. The description begins with the structure of a fuel injection system designated at numeral 1. In this embodiment, an engine 2 is of a four-cylinder four-cycle type, with each cylinder being provided with an injector 3 taking charge of the injection of fuel into a combustion chamber. The fuel injection time and injection time period of the injector 3 are controlled on the basis of the ON-OFF state of an injection control solenoid valve 4 situated in each injector 3. On the other hand, each injector 3 is coupled to a common rail 5 common to the respective cylinders. The common rail 5 serves as a fuel high pressure accumulator, and the high-pressurized fuel accumulated within the common rail 5 is injected through the injector 3 into the combustion chamber of the engine 2 while the injection control solenoid valve 4 is in the open condition. A variable-discharge high pressure pump 6 according to this invention, which always maintains a high fuel pressure, is communicated through a fuel pipe 7 to the common rail 5. The variable-discharge high pressure pump 6, when necessary, pressurizes the fuel sucked from a fuel tank 8 by a well-known low pressure pump 9 up to a high pressure value and then supplies it to the common rail 5. A control unit 10 for the control of the fuel injection system 1 receives, for example, the information on the engine state from a crank angle sensor, an engine speed sensor, a load sensor and so on. The control unit 10 outputs an ON-OFF control signal to the injection control solenoid valve 4 on the basis of the respective information to determine the optimal injection timing and injection time period. Simultaneously, the control unit 10 also supplies a control signal to the variable-discharge high pressure pump 6 so that the quantity of the fuel to be fed to the common rail 5 assumes an optimal value.

Secondly, a description will be taken hereinbelow of a construction of the variable-discharge high pressure pump 6. The variable-discharge high pressure pump 6 is equipped with a cam shaft 11 which gets into rotation in connection with a crank shaft of the engine 2. The cam shaft 11 is designed to rotate by half (½ revolution) while the crank shaft makes one revolution. A cam surface 12 is formed around this cam shaft 11. The cam surface 12 carries out the up and down stroke four times in accordance with one revolution of the cam shaft 11. That is, this is of a 4-height type. The cam shaft 11 is located within a cam chamber 14 positioned at a lower portion of a housing 13. The housing 13 accommodates a substantially cylindrical chamber 15 which in turn, accommodates a tappet 16 supported to be allowed to reciprocate therein. The tappet 16 is biased by a spring 17 toward the cam surface 12 side, and has a cam roller 18 in its cam surface 12 side. The cam roller 18 rotates along the cam surface 12 as it turns out in response to the rotation of the cam shaft 11, so that the tappet 16 displaces in accordance with the variation of the cam surface 12. One revolution of the cam shaft 11 creates four reciprocation of the tappet 16 within the cylindrical chamber 15.

In an upper portion (an upper side in FIG. 1 when being mounted on a motor vehicle), a cylinder head 20 is disposed to close the cylindrical chamber 15. A large-diameter recess section 20*a*, being a substantially bowl-like cavity, is made at a lower portion of the cylinder head 20 in the housing 13 side. In addition, a step portion 20*b* is formed along the circumferential direction in the middle of the large-diameter recess section 20*a*. Further, a small-diameter recess section 20*d* organizing a small-diameter recess section being a cylindrical through-hole is made in a central portion of a contact surface 20*c* being a bottom surface of the large-diameter recess section 20*a*. A substantially cylindrical cylinder 22 is disposed such that its one end surface is brought into contact with the contact surface 20*c* positioned at the central portion of the large-diameter recess section 20*a* of the cylinder head 20 and its cylindrical portion is connected to the small-diameter recess section 20*d*, and fixed by the help of the fixing means 23. The cylinder 22 is constructed to have a thick wall at its one end portion, thus comprising a short thick wall cylindrical section 22*a* and a long thin wall cylindrical section 22*b*. The thick wall cylindrical section 22*a* side end surface is placed into contact with the contact surface 20*c* of the cylinder head 20.

On the other hand, the fixing means 23 is made up of a thick wall disc-like body 23*a* and a cylindrical section 23*b* extending at right angles from the outer circumference of the body 23*a* to the main surface. In the fixing means 23, a through-hole 23*c* made in a central portion of the body 23*a* accepts the thin wall cylindrical section 22*b* of the cylinder 22. Further, a male screw portion 23*d* made in an outer circumferential portion of the body 23*a* is engaged with a female screw portion 20*e* formed in the inner side of the large-diameter recess section 20*a* of the cylinder head 20 so that a step portion 22*c* defined between the thick wall cylindrical section 22*a* of the cylinder 22 and the thin wall cylindrical section 22*b* thereof is pressed toward the cylinder head 20 side for tightening. The integral assembly of the cylinder head 20, the cylinder 22 and the fixing means 23 owing to the fixing means 23 is tightened vertically (in the illustration) to be connected to each other through bolts (not shown) situated between the housing 13 and the cylinder head 20 like the prior art. Further, O-rings 24 are respectively placed between the housing 13 and the cylinder head 20, between the housing 13 and the fixing means 23 and between the fixing means 23 and the cylinder 22 to ensure the airtightness. Still further, a low pressure fuel gallery 25 is defined by the outer surface of the thick wall cylindrical section 22*a* of the cylinder 22, the main surface of the body 23*a* of the fixing means 23 and the inner surface of the large-diameter recess section 20*a* of the cylinder head 20.

The inner side of the cylinder 22 has a cylindrical sliding surface 22*d* processed with a high accuracy. In the cylinder 22, a bar-like plunger 27 with a circular cross section is accommodated to be allowed to reciprocate in a state with being guided by the sliding surface 22*d*. The plunger 27 is a no stop groove type which does not have a stop groove for introducing fuel into cylinder. The head portion of the plunger 27, in conjunction with the small-diameter recess section 20*d* of the cylinder 20, constitutes the pump chamber 21. The lower end portion of the plunger 27 is in connecting relation to the tappet 16. Accordingly, the plunger 27 reciprocates in the cylinder 22 in accordance with the reciprocating movement of the tappet 16. In addition, the head portion of the plunger 27 compresses the fuel within the pump chamber 21.

To the cylinder head 20 there is attached fuel introduction means 28 for introducing fuel into the pump chamber 21, which is communicated through the fuel supply passage 29 with the low pressure fuel gallery 25. In addition, in the cylinder head 20 there is fitted a solenoid valve 30 energization-controlled by the control unit 10. This solenoid valve 30 has a well-known structure to open and close a fuel supply passage 31 for establishing communication between the low pressure fuel gallery 25 and the pump chamber 21. For example, the fuel supply passage is in the closed condition while the solenoid valve 30 is in the energized state, whereas the fuel supply passage 31 comes into the open condition in response to stopping the energization thereto.

Furthermore, to the cylinder head 20 there is attached a fuel discharging means 32 which guides the fuel compressed in the pump chamber 21 to the exterior of the variable-discharge high pressure pump 6. This fuel discharging means 32 acts as a joint to be connected to the fuel pipe 7 which in turn, is coupled to the common rail 5. In the interior of the fuel discharging means 32, a check valve 33 is provided in order to prevent the back flow of the fuel accumulated in the common rail 5 toward the variable-discharge high pressure pump 6.

A description will be made hereinbelow of an operation of the fuel injection system 1 and an operation of the variable-discharge high pressure pump 6. When the engine 2 is driven to rotate the crank shaft and the plunger 27 falls, the control unit 10 stops the energization to the solenoid valve 30. Thus, the supply of fuel takes place in the order of the fuel introduction means 28 the fuel supply passage 29 the low pressure fuel gallery 25 the fuel supply passage 31 the pump chamber 21. On the other hand, when the solenoid valve 30 is subjected to the energization or when the energization stops, the plunger 27 can rise. When the control unit 10 stops the energization to the solenoid valve, the plunger 27 comes up to compress the fuel within the pump chamber 21. However, since the fuel supply passage 31 is in the open state, the pressure within the pump chamber 21 can not reach a value to open the check valve 33, with the result that the fuel returns through the fuel supply passage 31 and further a relief joint (not shown) of the fuel introduction means 28 to the fuel tank 8. Further, when the energization to the solenoid valve 30 occurs by the control unit 10 in the middle of the rise of the plunger 27, the fuel compressed within the pump chamber 21 in accordance with the rise of the plunger 27 stops to escape from the fuel supply passage 31 and hence is pressurized to take a high pressure condition. When the pressure within the pump chamber 21 overcomes the check valve 33 in due time, the check valve 33 is opened to discharge the pressurized fuel through the fuel discharge means 32 into the common rail 5.

Figure 3:
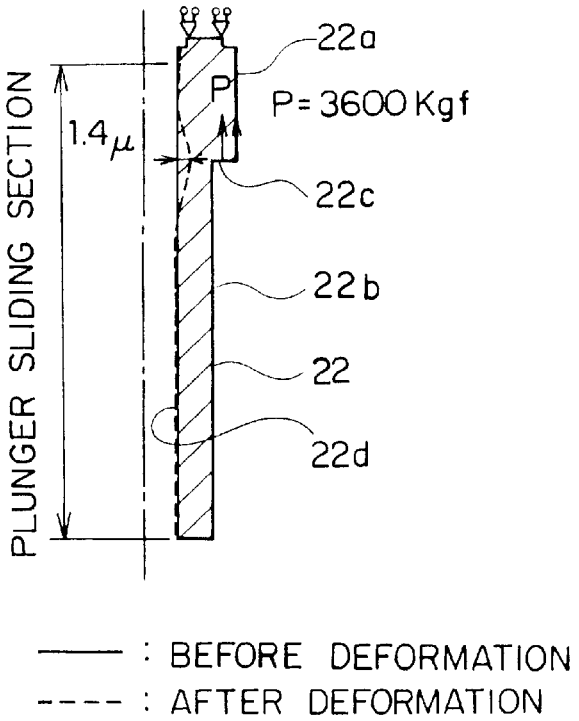
FIG. 3 shows a structural analysis result of a cylinder after the completion of assembling of a variable-discharge high pressure pump according to this invention.

FIG. 3 shows a structural analysis result of the cylinder 22 after the completion of assembling of the variable-discharge high pressure pump according to this invention. In the illustration, only one side of the cross section of the cylinder 22 is shown while the other side thereof is omitted. The cylinder 22 is fixed in such a way that the step portion 22*c* defined between the thick wall cylindrical section 22*a* and the thin wall cylindrical section 22*b* is pressed toward the cylinder head 20 side. At this time, the force P, being approximately 3600 kgf, works by the foxing means 23. This force P deforms the sliding surface 22*d* being the inner circumferential surface of the cylinder 22 as indicated by a dotted line in the illustration. That is, the sliding surface 22*d* near the step portion 22*c* becomes inflated outwardly to form a ring-like configuration. Moreover, a room (or space) is defined between the outer circumferential surface of the plunger 27 and the sliding surface 22*d*. When the pump is driven, this room accepts and retains the fuel leaking through the gap between the plunger 27 and the cylinder 22, and, therefore sufficiently provides the lubrication for the sliding movement of the plunger 27.

In this variable-discharge high pressure pump 6 thus constructed, the cylinder head 20 supporting the solenoid valve 30, the fuel discharging means 32 and the fuel introduction means 28 is separated from the cylinder 22 for accommodating the plunger 27. As a result of this construction, the cylinder 22 can take a simple substantially cylindrical configuration. The cylinder 22 is required to be manufacturing with a high accuracy like the prior art in order to ensure the smooth guidance for the plunger 27. However, its configuration is simple, the processing becomes easy. In addition, the cylinder 22 is not affected by the deformation of the cylinder head 20 due to the installation of the solenoid valve 30 and the fuel discharging means 32 after the completion of the final assembling, and hence the cylinder head 20 does not require an extremely high rigidity.

Moreover, since the cylinder 22 is in the separation from the cylinder head 20, the deformation to hinder the sliding action of the plunger 27 does not occur. On the other hand, the cylinder 22 deforms to define the room in conjunction with the outer circumference of the plunger 27 when being tightened by the fixing means 23, so that the leaked fuel stays in this room to provide the sufficient lubrication for the sliding action of the plunger 27. This lubrication is effective to the sliding movement of the plunger 27, that is, effective to the seizure of the plunger 27 and others. The lubrication can sufficiently cope with the higher-speed sliding movement of the plunger 127 made in proportion to the recent increase in the number of heights of the cam. Moreover, when the plunger 27 gets into the seizure, the plunger 27 and the cylinder 22 are replaced with new ones. In this case, since the cylinder 22 is separated from the cylinder head 20, the replacing work becomes more facilitated as compared with the prior art.

Second Embodiment

Figure 4:
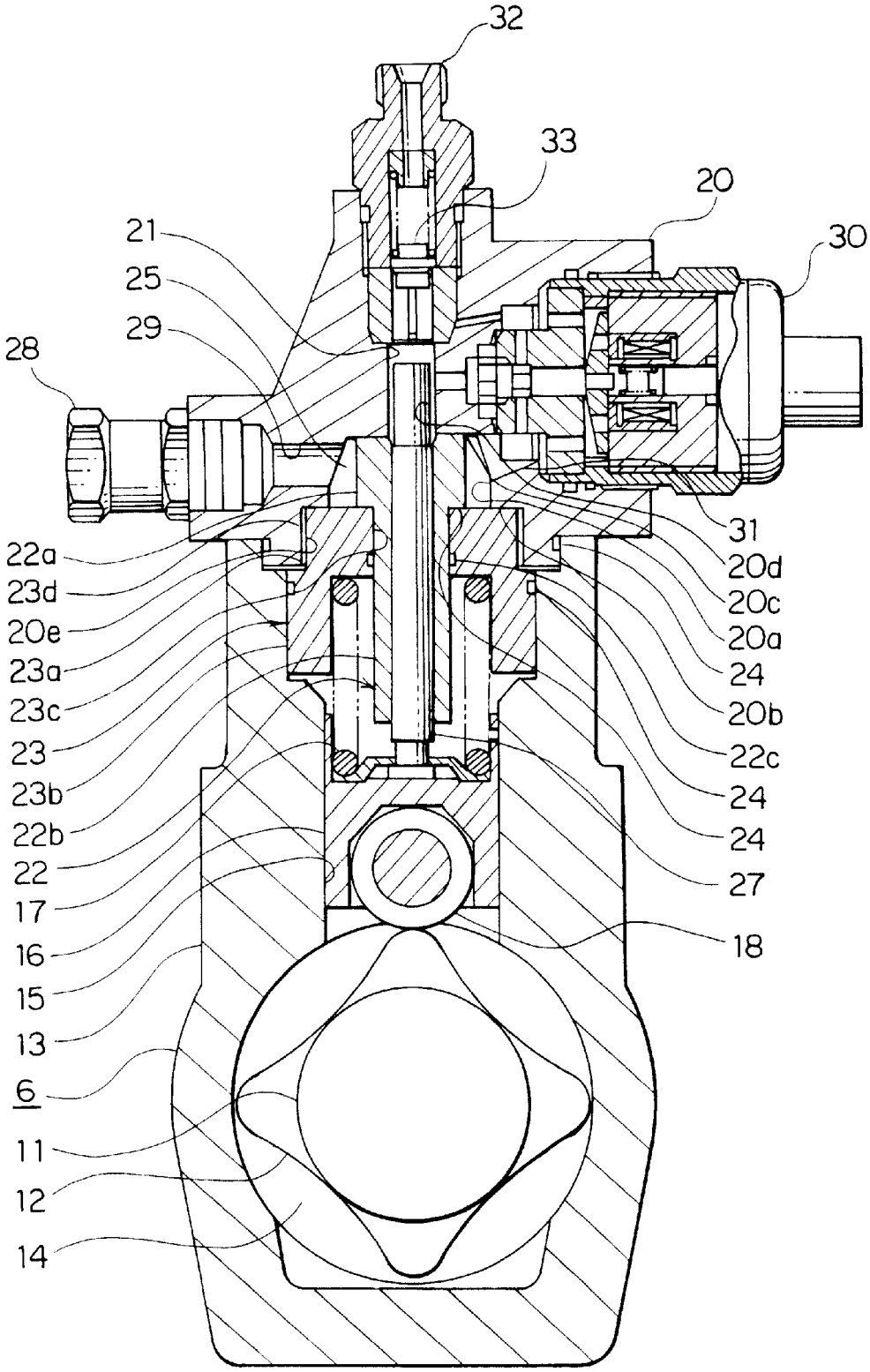
FIG. 4 is a cross-sectional view showing another example of a variable-discharge high pressure pump according to this invention.
Figure 5:
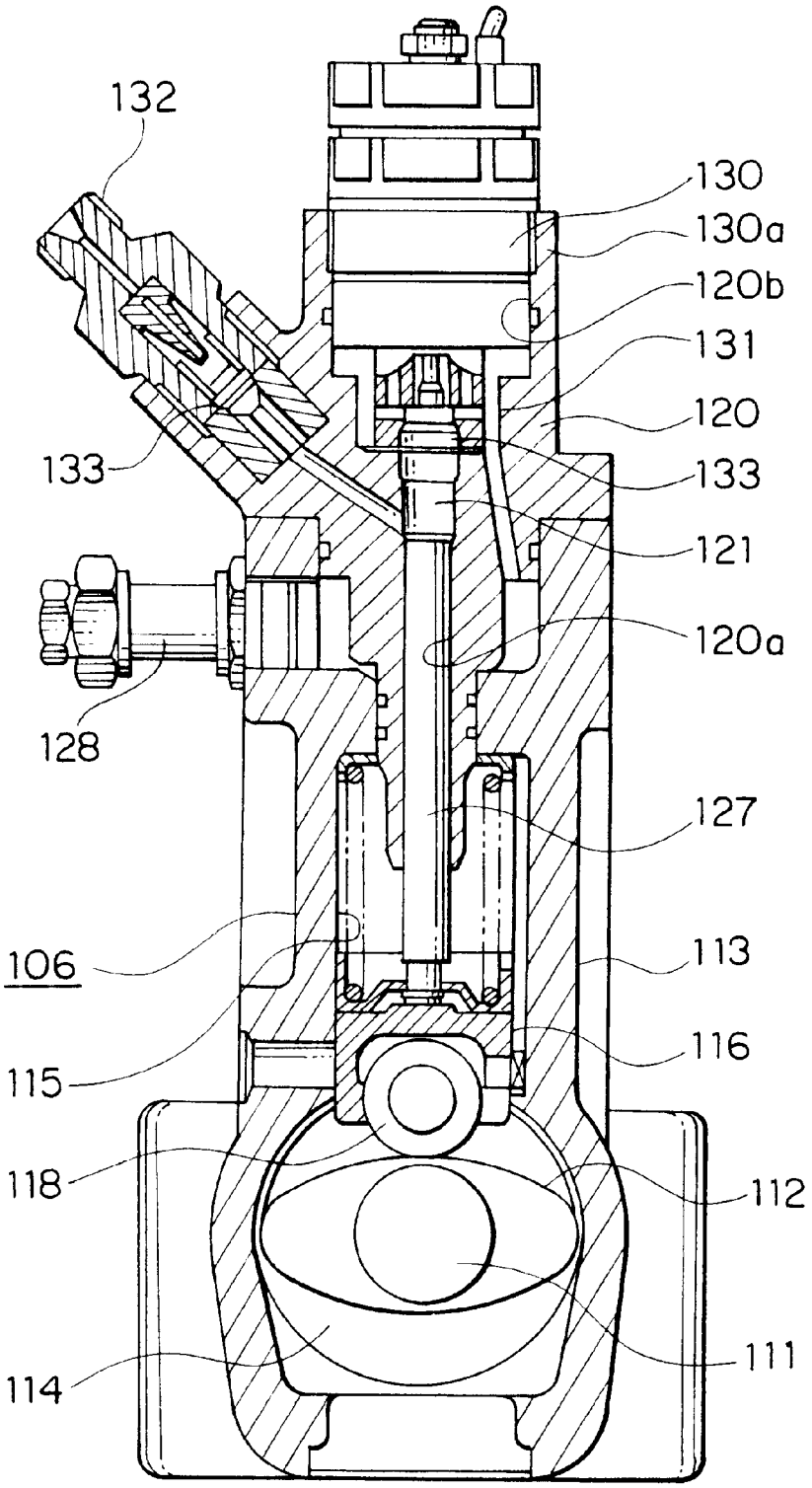
FIG. 5 PRIOR ART
FIG. 5 is a cross-sectional view showing a prior variable-discharge high pressure pump.
Figure 6:
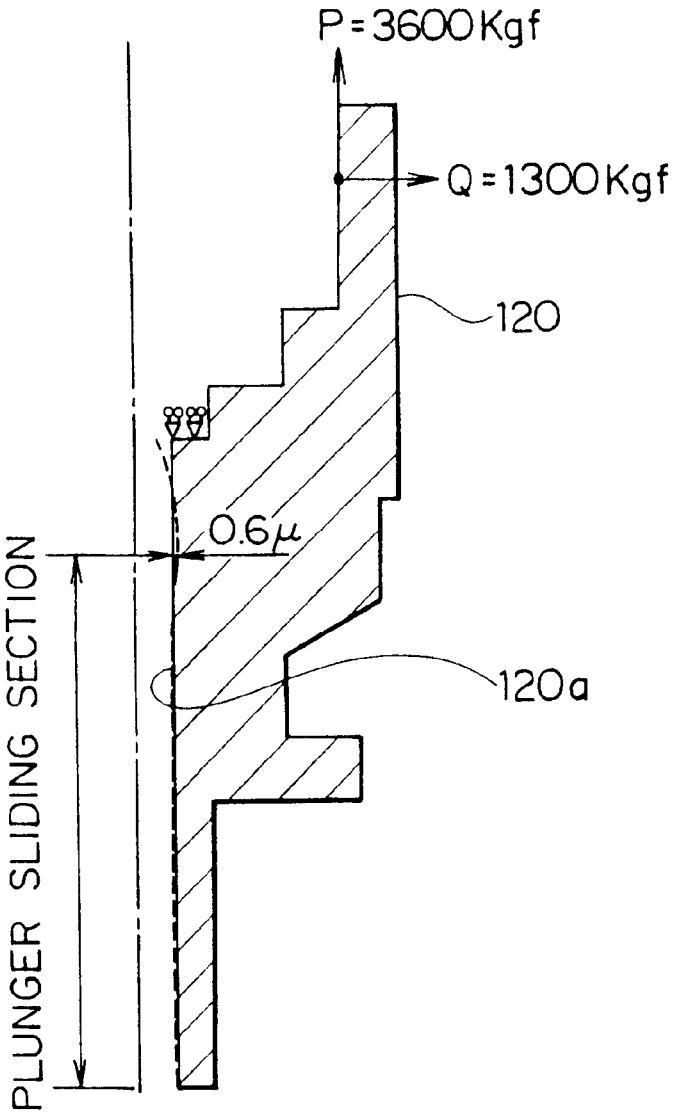
FIG. 6 PRIOR ART
FIG. 6 shows a structural analysis result of a cylinder after the completion of assembling of a prior variable-discharge high pressure pump.

FIG. 4 is a cross-sectional view showing another example of a variable-discharge high pressure pump according to the present invention. In this embodiment, for the installation on the cylinder head 20, the solenoid valve 30 and the fuel discharging means 32 are interchanged in position. The solenoid valve 30 is located to make right angles to the cylinder. The remaining structure is the same as that of the above-described first embodiment. In general, the solenoid valve 30 has a larger diameter than that of the fuel discharging means 32, and the deformation degree of the cylinder head 20 is higher than that of the fuel discharging means 32. For these reasons, in the prior art the solenoid valve is located and disposed on the extension of the axis of the plunger sliding section in order to prevent the fitting of the solenoid valve from having adverse influence upon the plunger sliding section. On the other hand, in the variable-discharge high pressure pump according to this embodiment, the deformation of the cylinder head 20 does not have adversely affect the cylinder 22 and does not hinder the sliding action of the plunger 27, and hence the solenoid valve 30 can also be fitted to meet at right angles to the cylinder 22.

In the variable-discharge high pressure pump with such a structure, even if the solenoid valve 30 is located to meet at right angles to the cylinder 22, the installation of the solenoid valve 30 does not cause the cylinder 22 to deform to hinder the sliding motion of the plunger 27. In addition, since the solenoid valve 30 is able to be disposed to meet at right angles to the cylinder 22, the fuel supply passage 31 becomes short, thus improving the system characteristic. More specifically, shortening the fuel supply passage 31 can facilitate the processing and further reduce the flow resistance of fuel. Moreover, if the solenoid valve 30 is disposed to meet at right angles to the cylinder 22, the whole system results in a compact configuration. Besides, the cylinder 20 is not required to have an extremely high rigidity, and the solenoid valve 30 can be placed on any portion of the cylinder head 20, which allows easy designing.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. A variable-discharge high pressure pump comprising:

a cam shaft driven to rotate and provided with a cam surface therearound;

a tappet pressed against said cam surface to displace in accordance with said cam surface;

a housing for holding said tappet to allow it to reciprocate;

a pole-like plunger having no stop groove and connected to said tappet to reciprocate therewith;

a cylindrical cylinder accommodating said plunger to allow it to reciprocate;

a cylinder head having a contact surface brought and placed into contact with one end surface of said cylinder and including a small-diameter recess portion made in said contact surface to be coupled to said cylinder and to constitute a pump chamber in conjunction with a head portion of said plunger;

fuel introduction means placed on said cylinder head to introduce external fuel into a fuel supply passage communicating with said pump chamber;

a solenoid valve installed on said cylinder head to open and close said fuel supply passage in accordance with an energization state thereto;

fuel discharging means fitted on said cylinder head to discharge fuel compressed in said pump chamber; and fixing means for bringing and placing said cylinder into contact with said cylinder head.

2. A variable-discharge high pressure pump as defined in claim 1, wherein said cylinder is composed of a thick wall cylindrical section and a thin wall cylindrical section, and a step portion defined between said thick wall cylindrical section and said thin wall cylindrical section is pressed toward said cylinder head so that its thick wall cylindrical section side end surface is brought and placed into contact with said contact surface of said cylinder head.

3. A variable-discharge high pressure pump as defined in claim 2, wherein said cylinder head has a large-diameter recess portion made about said contact surface and said small diameter recess portion, said fixing means has a disc-like fixing means body and said thin wall cylindrical section of said cylinder is inserted into a through-hole made at a central portion of said fixing means body to penetrate it and further a male screw portion made in an outer circumference of said fixing means is engaged with a female screw portion made in said large-diameter recess portion and then said step portion of said cylinder is pressed toward said cylinder head, and a low pressure fuel gallery is defined by an inner surface of said large-diameter recess portion, an outer surface of said thick wall cylindrical section of said cylinder and a main surface of said fixing means body.

* * * * *